US005181996A

United States Patent [19]

Bagg

[11] Patent Number: 5,181,996

[45] Date of Patent: Jan. 26, 1993

[54] ELECTROCHEMICAL GENERATION OF DINITROGEN PENTOXIDE IN NITRIC ACID

[75] Inventor: Greville E. Bagg, Waltham Abbey, England

[73] Assignee: The Secretary of State for Defence in Her Britannic Majesty's Government of the United Kingdom of Great Britain and Northern Ireland, London, England

[21] Appl. No.: 730,969

[22] PCT Filed: Dec. 14, 1989

[86] PCT No.: PCT/GB89/01497

§ 371 Date: Jul. 23, 1991

§ 102(e) Date: Jul. 23, 1991

[87] PCT Pub. No.: WO90/07020

PCT Pub. Date: Jun. 28, 1990

[30] Foreign Application Priority Data

Dec. 16, 1988 [GB] United Kingdom ..... 8829449

[51] Int. Cl.[5] ..... C25B 1/00

[52] U.S. Cl. ..... 204/101; 204/103

[58] Field of Search ..... 204/101, 103

[56] References Cited

U.S. PATENT DOCUMENTS 4,432,902 2/1984 McGuire et al. ..... 204/59 R
4,443,308 4/1984 Coon et al. ..... 204/103
4,525,252 6/1985 McGuire et al. ..... 204/103

*Primary Examiner*—John Niebling
*Assistant Examiner*—David G. Ryser
*Attorney, Agent, or Firm*—Nixon & Vanderhye

[57] ABSTRACT

A two-stage method of producing $N_2O_5$ in nitric acid from $N_2O_4$ in nitric acid consists of a first production stage in which the anodic oxidation of $N_2O_4$ in nitric acid and cathodic reduction of nitric acid are separated by a non-ionic or anionic ion exchange membrane, and a second production phase in which the product of the first stage anodic reaction is subjected to further anodic oxidation, the anodic and cathodic reactions being separated by a cationic ion exchange membrane. The use of a cationic membrane in the second stage promotes, through leakage of $N_2O_4$ to the catholyte, an increase in $N_2O_5$ concentration and decrease in $N_2O_4$ concentration within the anolyte acid while avoiding a significant loss of current efficiency. The two stages may be connected in series and operated continuously to produce a nitric acid solution containing typically 32 wt. % $N_2O_5$ and less than 2 wt. % $N_2O_4$.

17 Claims, 7 Drawing Sheets

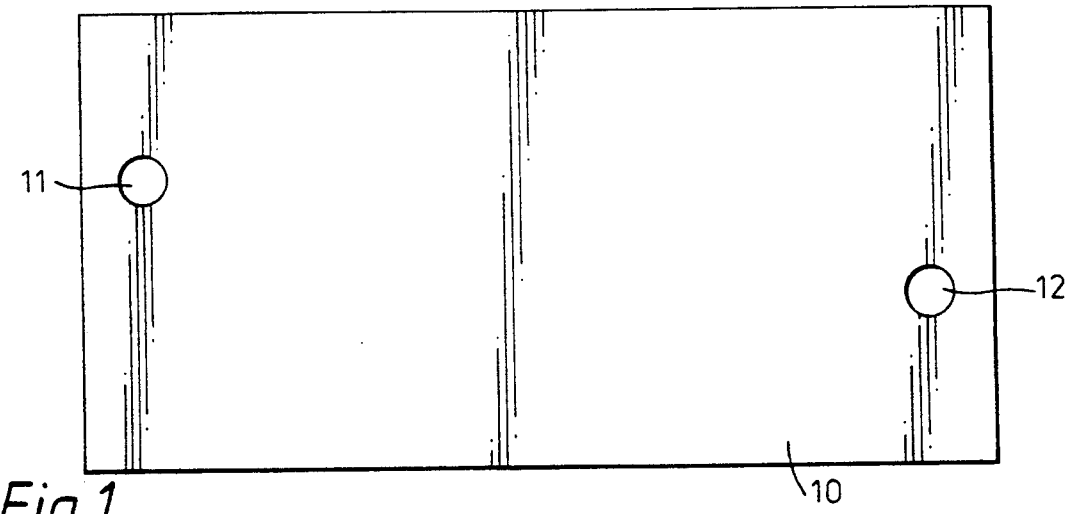
Fig. 1.
Fig. 2.
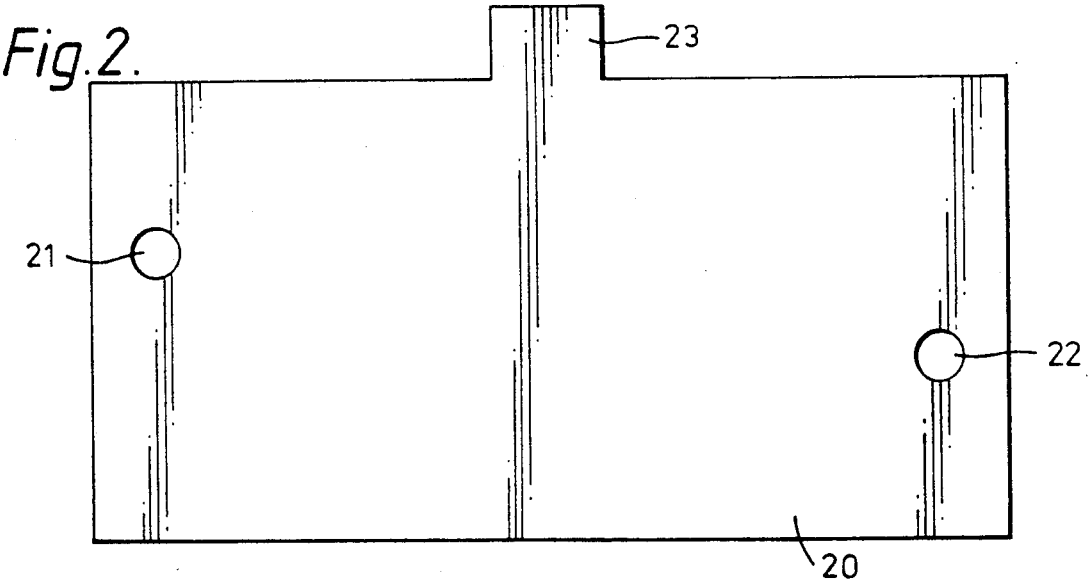
Fig. 3.
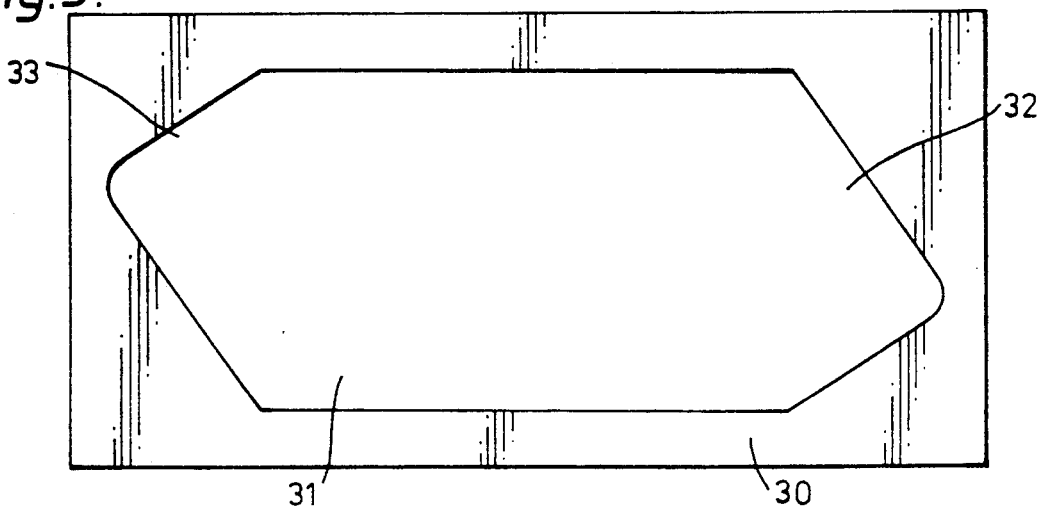

ELECTROCHEMICAL GENERATION OF DINITROGEN PENTOXIDE IN NITRIC ACID

This invention relates to a process for the electrochemical generation of dinitrogen pentoxide ($N_2O_5$) in nitric acid.

It has been known for many years that $N_2O_5$ can be produced by the simultaneous anodic oxidation of dinitrogen tetroxide ($N_2O_4$) in nitric acid and cathodic decomposition of nitric acid. Such reactions are conveniently conducted in electrochemical cells, in which the following principle reactions take place Anode Reaction:

$$N_2O_4+2HNO_3 \rightarrow 2N_2O_5+2H^+ +2e$$

Cathode Reaction:

$$2HNO_3+2H^+ +2e \rightarrow N_2O_4+2H_2O$$

Overall Cell Reaction: $4HNO_3 \rightarrow 2N_2O_5+2H_2O$

In practice, in order to prevent the decomposition of the $N_2O_5$ product, the anode and cathode reactions are usually separated by a membrane which keeps apart the $N_2O_5$ formed at the anode from the water formed at the cathode. The membrane therefore effectively divides the interior of the cell into an anode space and a cathode space.

One problem associated with known processes which exploit these electrochemical reactions in the production of $H_2O_5$ in nitric acid, is that the current efficiency of these processes, which is the ratio of the actual mass of $N_2O_5$ liberated in the anode reaction by a given current between the anode and cathode to that which should theoretically be liberated according to Faraday's Law, has hitherto found to be low leading to high production costs. This problem has lead to the formulation of processes designed to increase current efficiency and reduce specific power consumption.

One such process is described in German Patent No. DE-884,356 (Wendlant et al). $N_2O_4$ in nitric acid is continuously added to both the anode and cathode spaces either side of a permeable membrane in a electrochemical cell, and the product acid containing $N_2O_5$ is continuously drawn off from the anode space before the complete anodic conversion therein of tetroxide to pentoxide. A disadvantage of this process is that although higher current efficiencies and lower specific power consumptions are reported by utilising an incomplete conversion of tetroxide to pentoxide, the appreciable amounts of tetroxide left over at the end of anodic oxidation represent a significant reduction in the overall yield of $N_2O_5$ over that which is theoretically possible, and constitute an unwanted contaminant in the product acid.

More recently, in a further batch process described in U.S. Pat. No. 4,432,902 (Coon et al) some improvement in current efficiency is reported by maintaining a carefully controlled potential difference between the anode and cathode spaces. However, the relatively complex control system employed by Coon et al is not readily adapted for use in semi-continuous and continuous methods of production, which means that the usefulness of this technique is generally restricted to small scale production of $N_2O_5$.

It has now been discovered that the problem of contamination with $N_2O_4$ can be largely overcome by the partial use of cationic ion exchange membranes between the anodic and cathodic spaces, which are found to retain $N_2O_5$ within the anodic space but permit leakage of $N_2O_4$ contamination from the anodic space to the cathodic space. This has in turn made it possible to produce highly concentrated mixtures of $N_2O_5$ in nitric acid which have hitherto not been attainable by the aforementioned known processes and at the same time permit migration of $N_2O_4$ liquid from the anode to the cathode liquid.

According to the present invention there is provided a method for the electrochemical generation of dinitrogen pentoxide ($N_2O_5$) by the simultaneous anodic oxidation of $N_2O_4$ in nitric acid and cathodic decomposition of nitric acid, wherein the $N_2O_5$ is generated in two production stages, a first stage in which the anodic and cathodic reactions are separated by an anionic or a non-ionic, semi-permeable ion exchange membrane and a second stage in which the product of the anodic reaction from the first stage is subjected to further anodic oxidation, the anodic and cathodic reactions of the second stage being separated by a cationic ion exchange membrane.

In the first stage of anodic oxidation, the anodic and cathodic liquids (anolyte and catholyte) are separated by an anionic or a non-ionic (semi-permeable) ion exchange membrane. This is because using such membranes, generally higher rates of $N_2O_5$ production per unit area of membrane and generally higher current efficiencies are possible than if cationic membranes are used, particularly when the anolyte contains high levels of $N_2O_4$ and low levels of $N_2O_5$.

The predominant, current carrying ionic species through an anionic membrane is found to be the anion $NO_3^-$ from the cathode to the anode, whereas through a non-ionic, semi-permeable membrane the predominant current-carrying ionic species are found to be $NO_3^-$ from the cathode to the anode, and $NO^+$ from the anode to the cathode. As the anodic reaction proceeds towards completion, migration of $NO_3^-$ ions is manifested by a loss of nitric acid from the cathode space to the anode space whereas migration of $NO^+$ ions is manifested by a loss of $N_2O_4$ from the anode space to the cathode space. Migration of $NO_3^-$ ions means that further nitric acid must be continuously added to the cathode space to prevent the concentration of water and $N_2O_4$ being generated therein from becoming too high and so increase their rate of migration to the anode space due to osmotic pressure effects across the membrane. Migration of water is particularly serious because because it will react with $N_2O_5$ generated in the anode space to form nitric acid. Furthermore, a steady increase of nitric acid in the anode compartment prevents a high concentration of $N_2O_5$ from being attained therein. When the membrane is a non-ionic, semi-permeable membrane, the current efficiency tends to be higher at least in part because more ionic species are being transported and for this reason such membranes are preferred in the first stage of production.

In the second stage of oxidation, the invention utilises the high rate of $N_2O_4$ migration through cationic ion exchange membranes from the anode space to the cathode space which occurs without a reverse flow of $NO_3^-$ ions to the anode space. This effect is undesirable during the bulk of $N_2O_4$ oxidation to $N_2O_5$ because it reduces the amount of $N_2O_4$ available in the anode space for conversion to $N_2O_5$, and reduces the mass of the anolyte (i.e. acid product) available for recovery. However, towards the end of anodic oxidation where $N_2O_4$ levels are low and $N_2O_5$ levels are reaching their peak, this effect provides a means of effectively and rapidly increasing $N_2O_5$ concentration and removing unwanted $N_2O_4$ from the anolyte which avoids the inefficient oxidative conversion of all this remaining $N_2O_4$ to $N_2O_5$.

Within the anolyte there are present two cationic species which are found to migrate across a cationic ion exchange membrane under the influence of an applied voltage. These are $NO^+$, which is derived from $N_2O_4$ and so its migration leads to a loss of $N_2O_4$ to the catholyte, and (to a lesser extent) $NO_2^+$ which is derived from $N_2O_5$ and so its migration leads to a loss of $N_2O_5$. Within the anolyte, as $N_2O_5$ concentration increases and $N_2O_4$ concentration decreases, so the concentration of $NO_2^+$ ions increases and $NO^+$ ions decreases. This alteration in ionic concentration within the anolyte would be expected to lead to an increased rate of $N_2O_5$ loss over $N_2O_4$ loss through the cationic membrane. However, surprisingly even at high concentrations of $N_2O_5$ within the anolyte of typically greater than 15 wt % in nitric acid and preferably greater than 20 wt % in nitric acid, it is found that electrolysis produces a steady decline in $N_2O_4$ concentrations coupled with a steady increase in $N_2O_5$ concentrations. In this way, an anolyte product containing more than 25 wt % $N_2O_5$ and less than 3 wt %, preferably less than 2 wt %, most preferably less than 1 wt %, $N_2O_4$ can be achieved without an undue expenditure of electrical energy. Since however $N_2O_5$ is generally produced more efficiently in the first stage rather than the second, it is preferred that at least 70% of the $N_2O_5$ produced in the present method is produced in the first production stage.

A second advantage of the two stage method of the present invention is that migration of $N_2O_4$ from the anolyte to the catholyte in the second stage in the absence of $NO_3^-$ ion migration from the catholyte inhibits the reverse migration of $N_2O_4$ and water from the catholyte to the anolyte. The anolyte is therefore relatively insensitive to the concentration of $N_2O_4$ and water in the catholyte. This means that relatively high concentrations of $N_2O_4$ may be employed in the catholyte used in the second stage, of preferably from 10 wt % to saturation, most preferably from 20 wt % to 30 wt %, so reducing the need to replenish the catholyte with fresh concentrated nitric acid. With increasing $N_2O_4$ concentration, the electrical conductivity of the catholyte tends to rise and so the overall electrical resistance hence power consumption in the second stage is also reduced. An $N_2O_4$ concentration in the second stage catholyte of at or approaching saturation, for example of 30 wt % or more, is especially preferred since any additional $N_2O_4$ formed in or transferred to the catholyte during the second stage of oxidation will tend to form a second, liquid phase therein which is easily separated from the nitric acid.

At the anode, $N_2O_4$ is oxidised in the presence of $HNO_3$ to $N_2O_5$. Whether the present method is batch, semi-continuous (consecutive batch) or continuous, the initial concentration of $N_2O_4$ in $HNO_3$ should be high enough to allow the use, at least initially, of a high cell current in the first stage whilst maintaining good power efficiency. Preferably the wt % of $N_2O_4$ in $HNO_3$ in the first stage anolyte is between 10% and saturation, especially between 20% and saturation. During continuous operation, the concentration of $N_2O_4$ in the anolyte passed into the first anodic oxidation stage of the process is preferably maintained within these limits. The concentration of $N_2O_4$ in the anolyte passed into the second stage should preferably be from 3 to 25 wt %, more preferably from 5 to 15 wt %.

At the cathode, $HNO_3$ is reduced to $N_2O_4$. Therefore, during the electrolysis, the $N_2O_4$ concentration will build up in the catholyte, a result of this reduction (of $HNO_3$) and of the migration of $N_2O_4$ from the anolyte in the first and second stages of the process. Preferably, the concentration of $N_2O_4$ in the catholyte is maintained within the range 5 wt % to saturation, i.e. around 33% (by weight), especially between 10 and 30%. The maintenance of these $N_2O_4$ levels in the catholyte allows the process to operate using a high current and a low voltage (thereby high power efficiency). Furthermore, by maintaining these preferred levels of $N_2O_4$ in the catholyte in the first stage of the process, the $N_2O_4$ concentration gradient across the cell membrane is lowered, and this, in turn, discourages the loss of $N_2O_4$ from the anolyte by membrane transport.

As has been noted above, $N_2O_4$ is formed in the catholyte during the course of the present method. It follows that in order to maintain the $N_2O_4$ concentration in the catholyte between the above preferred limits, it may be necessary to remove $N_2O_4$ from the catholyte as the electrolysis progresses. This may most readily be done by distilling $N_2O_4$ from the catholyte. In one particularly preferred embodiment of the present method, when operated in a continuous mode, the $N_2O_4$ removed from the catholyte is added to the anolyte preferably after drying the $N_2O_4$ to remove moisture which would otherwise contaminate the anolyte.

It is possible to operate either stage of the present method with $N_2O_4$ separating as an upper layer above the catholyte, from whence it may be distilled into the anolyte simply by maintaining the cathodic reaction at a higher temperature, typically from 5° C. to 25° C. higher, than the anodic reaction, so as to maintain a higher vapour pressure of $N_2O_4$ in the catholyte.

The present method is preferably performed whilst maintaining the temperature of the anolyte between 5° and 25° C., especially 10° to 15° C. It may be necessary to cool the cell and/or the catholyte and anolyte in order to maintain the temperature between these limits. This may be done, for example by the use of heat exchangers.

The current density employed during the present electrolysis across each electrode is preferably between 50 and 2000 Amps.$m^{-2}$. The optimum current used in each stage of electrolysis will be determined primarily by the surface area of the anode and cathode, by the $N_2O_4$ concentration in the anolyte and catholyte, by the flowrates of the electrolytes and the characteristics of the membranes. Generally, the higher the $N_2O_4$ concentration in the anolyte and catholyte, the higher the cell current that may be maintained at a given power efficiency. The cell voltage between the anode and cathode during each stage of the present electrolysis is preferably between +1.0 and +10 Volts, more preferably between +1.5 and 8 Volts, most preferably between +2 and +6 Volts, the actual voltage required being determined primarily by the current to be passed and the nature of the membrane. Although it is not necessary to measure the anode potential during the course of the present process the present inventor has noted that the most efficient conversion of $N_2O_4$ to $N_2O_5$ by the process of the present invention takes place when the cell voltage employed leads to an anode potential (vsSCE) of between +1.0 and 4.5 V.

Each stage of the present method is preferably performed in one or more electrochemical cells each having an anode plate situated in an anode compartment and a cathode plate situated in a cathode compartment, the anode plate and the cathode plate being in a substantially parallel relationship. The preferred cell has an inlet and an outlet to both its anode and cathode, the positions of which allow electrolyte to flow continuously into and out of the compartments past the respective electrodes. The parallel plate electrode geometry of the cell is designed to promote a uniform potential distribution throughout the cell. The cell design also facilitates variation of the interelectrode gap. Generally a narrow gap between the electrode is preferred, since this minimises the cell volume and the potential drop across the electrolytes.

The anode and the cathode are each formed from a conductive material capable of resisting the corrosive environment. For example, the anode may comprise Pt, or Nb or Nb/Ta 40:60 alloy with a catalytic platinum or iridium oxide coating. The cathode, on the other hand, may comprise Pt, stainless steel, Nb or Nb/Ta 40:60 alloy.

The membranes used in each stage must have sufficient chemical stability and mechanical strength to withstand the hostile environment found during the present process. Suitable membranes must also have a low voltage drop, in order to minimise electrical power consumption at any given current density. Membranes comprising polymeric perfluorinated hydrocarbons generally meet these requirements. In one embodiment of the present invention, the membrane used in the first stage is a polymeric perfluorinated hydrocarbon non-ionic ion exchange membrane optionally containing up to 10% by weight of a fibrous or particulate filler. In another, and preferred, embodiment the membrane used in the second stage is a polymeric perfluorinated cationic ion exchange membrane carrying sulphonate ionic species linked thereto, especially of the type sold under the Trade Mark Nafion, preferably Nafion 423 or 425. Each membrane is preferably mounted in an electrochemical cell between and in parallel relationship to an anode and a cathode. Since even the strongest and most stable of membranes will eventually be affected by the hostile environment in which they have to operate during the course of the present method, the membrane state and integrity should preferably be examined from time to time, especially by measuring the membrane potential drop.

The design of the preferred electrochemical cell used in each stage facilitates the scale up of the present method to an industrial level. The working surface of the anode and cathode can vary, depending on the scale of the present method. However, the ratio of the area of the anode to the volume of the anode compartment is preferably kept within the range 0.1 and 10 $cm^2ml^{-1}$.

In at least one, and, preferably, both stages of the present method, anolyte is preferably recirculated through the anodic reaction. This has the effect of increasing the flowrate through the cell to provide a more turbulent flow and so a generally lower cell electrical resistance. It also reduces the concentration gradient of components within the anolyte through the anodic reaction for any given rate of $N_2O_5$ production.

In a preferred embodiment of a method according to the present invention operated continuously, both anodic oxidation stages are connected in series with each stage preferably working under optimum conditions for its specific use, i.e. the first stage is operated to produce maximum quantities of $N_2O_5$ whereas that final stage is operated to reduce the $N_2O_4$ level to a minimum level, preferably less than 3 wt. %, more preferably less than 2 wt %, most preferably less than 1 wt %. The elecrolysed anolyte from the first stage, in which $N_2O_5$ concentration has been raised to the desired working level for that stage, is passed to the next stage, where $N_2O_5$ concentration can be further increased and/or $N_2O_4$ concentration can be decreased. Each stage may thus be operated under steady state conditions with the nitric acid flowing through the complete battery with the concentration of $N_2O_5$ increasing and the concentration of $N_2O_4$ decreasing in the anolyte at each stage. $N_2O_4$ may be distilled from the catholyte of all stages back to the starting anolyte preferably after drying.

By operation of the multi-stage process as a steady state with a constant composition in each stage, control of the process may be achieved by monitering the physical properties of its output stream and using this to control the cell potential or current, whichever is more convenient, in order to produce the steady state. The anolyte stream flowing through each stage is a three component stream containing nitric acid, $N_2O_5$ and $N_2O_4$. In a preferred method the first stage is operated with the anolyte feed in saturated equilibrium with $N_2O_4$ (i.e. about 33 wt % $N_2O_4$ at ambient temperatures) so that the anolyte reservoir can be operated as a temperature controlled two-phase system. This allows temperature to control $N_2O_4$ level, a simple technique, and eliminates the need for accurate dosing of $N_2O_4$ into the stream. Monitoring the density of the anolyte stream into the first stage anodic oxidation provides an indication of the $N_2O_5$ level because $N_2O_4$ level is constant, and can be used to control the current used in the first stage via a feedback circuit in order to maintain $N_2O_5$ levels to the required degree.

The output anolyte stream from the second stage can be monitered to determine $N_2O_4$ levels, by for example Laser-Raman spectroscopy.

Cells according to the invention may be connected in parallel in a battery of cells in one or both stages, to increase the effective electrode area and increase the throughput of the electrolytic process.

The electrolytic process of the present invention will now be described by way of example only, with particular reference to the Figures in which, FIG. 1 represents a plan view of a PTFE back plate, which acts as a support for either an anode or a cathode, forming part of an electrochemical cell for use in the process, FIG. 2 represents a plan view of a platinised Ti anode or a niobium cathode, FIG. 3 represents a plan view of a PTFE frame separator, for separating either the anode or the cathode from a cell membrane.

Figure 6:
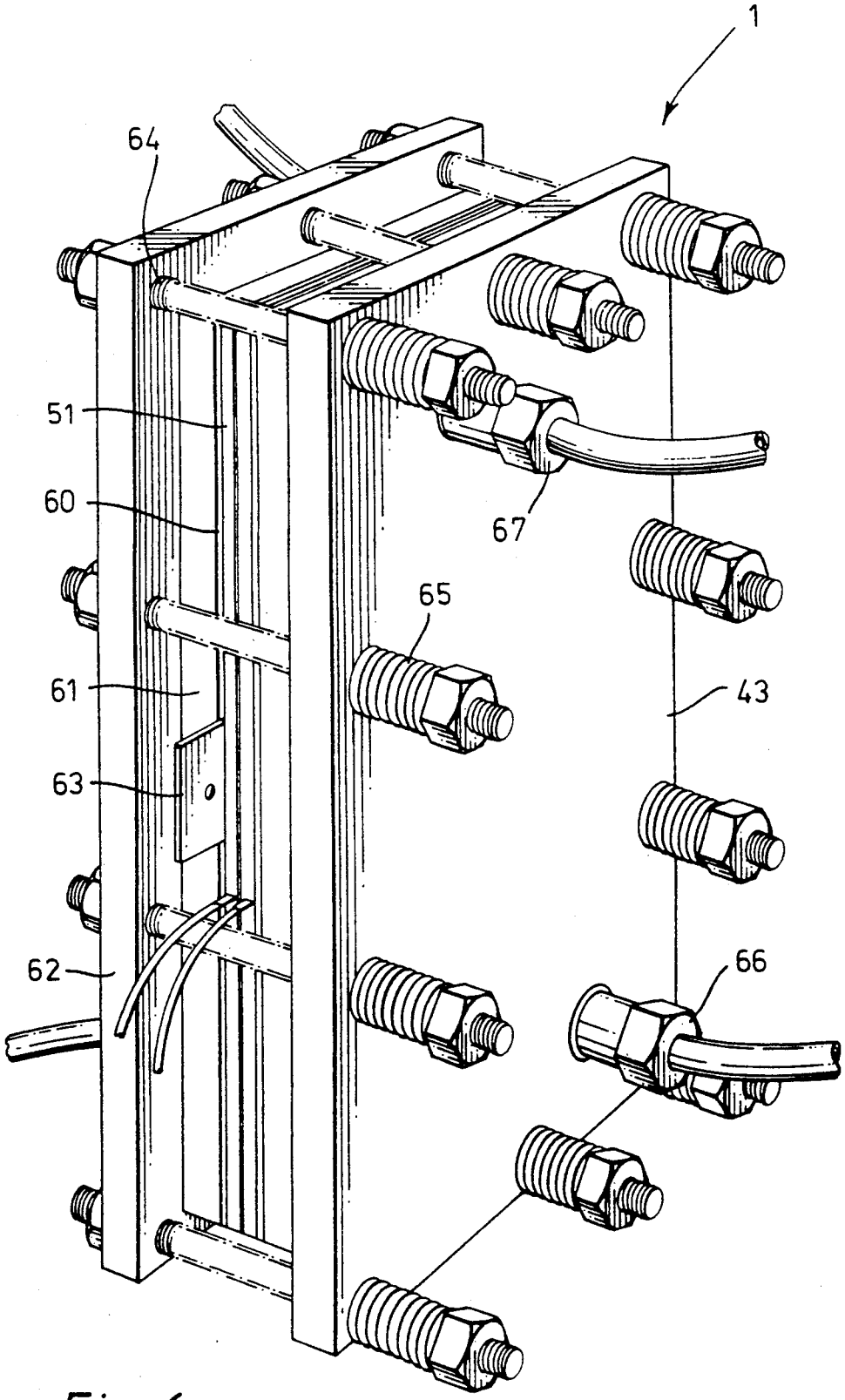
Figure 7:
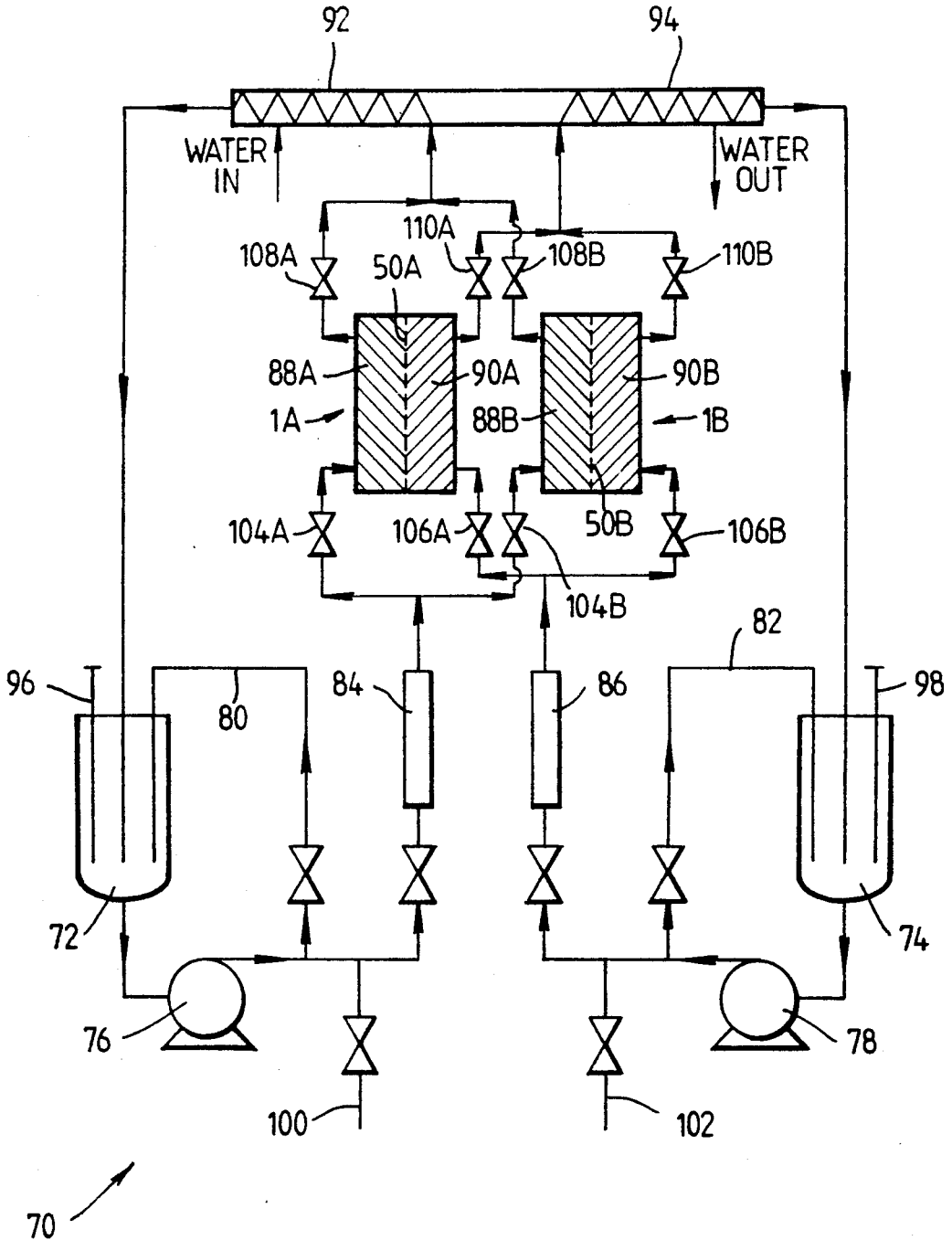
Figure 8:
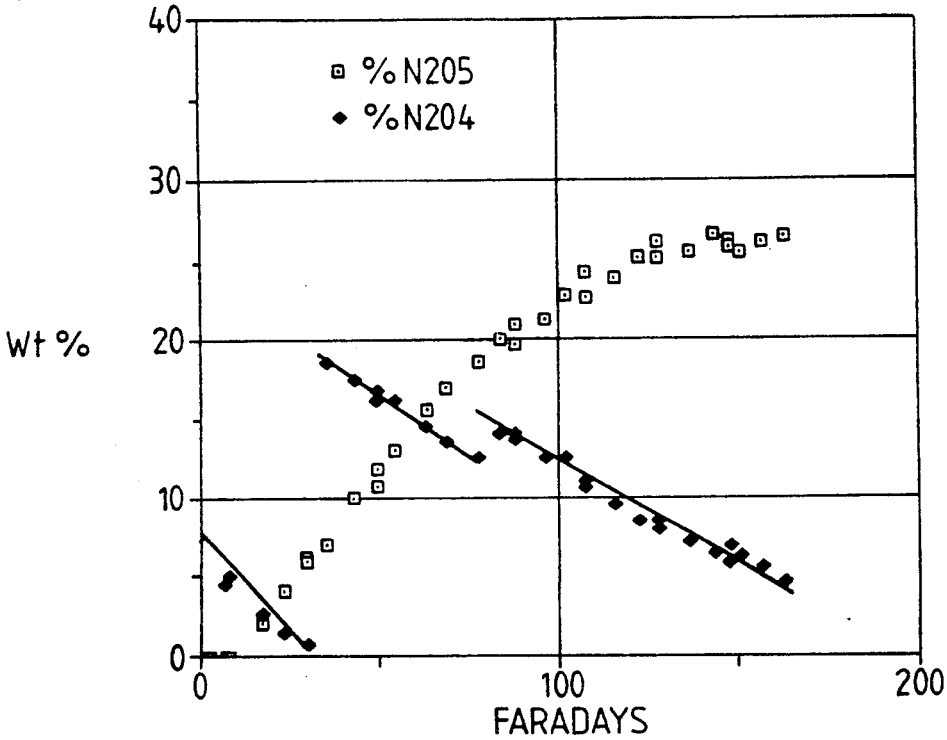
Figure 9:
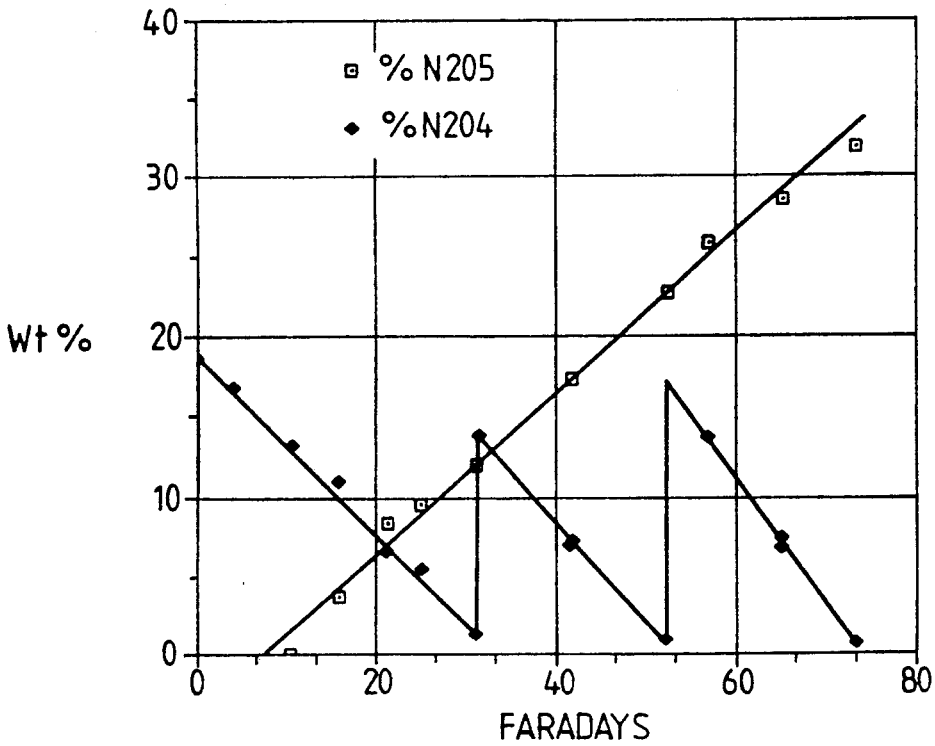
Figure 10:
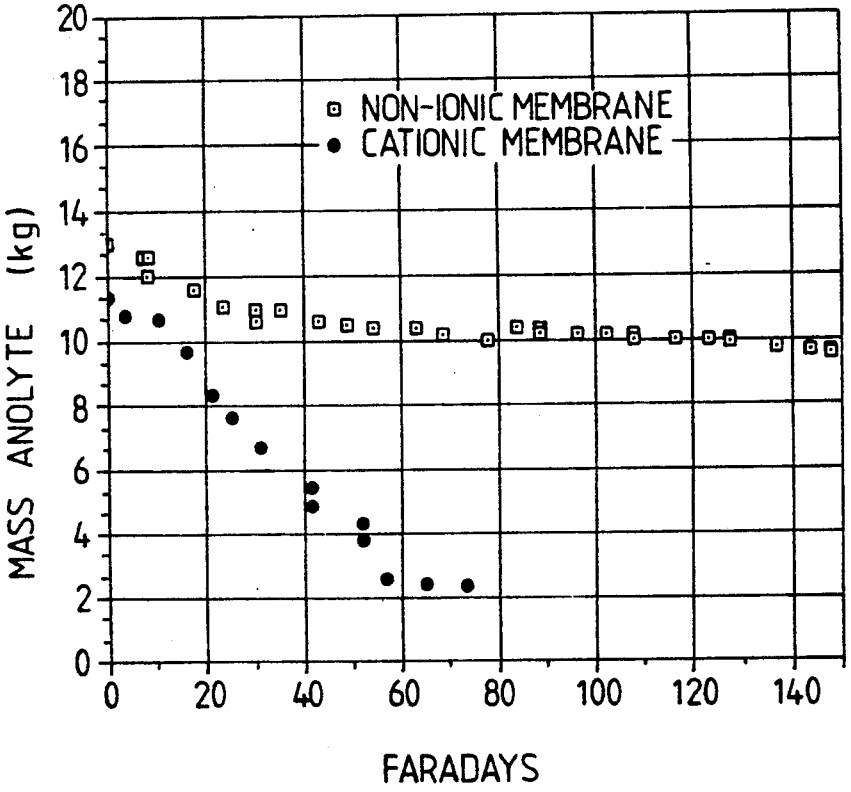
Figure 11:
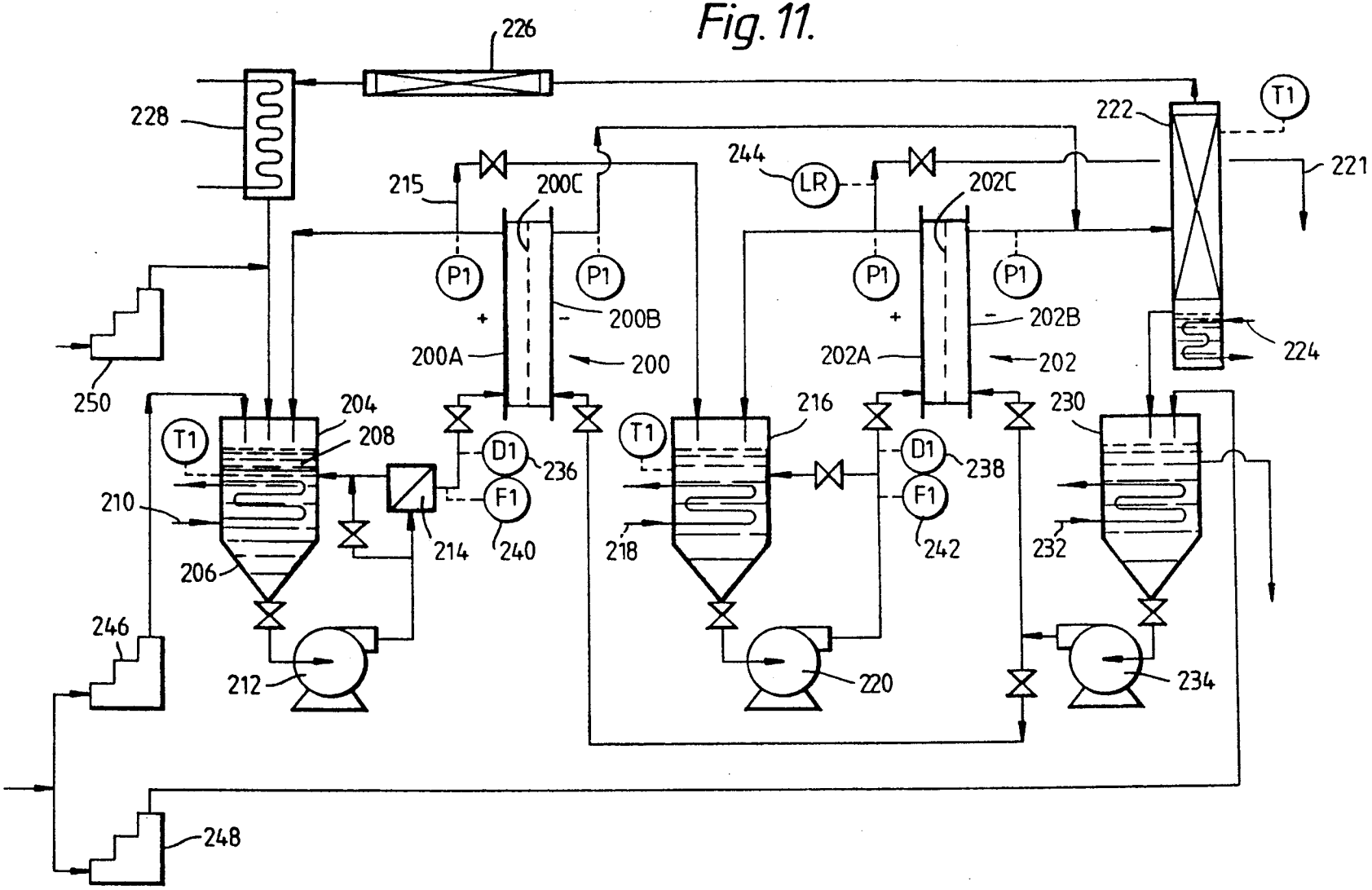

FIG. 6 represents a perspective view of an assembled cell consisting of the two halves separated by a membrane, FIG. 7 represents a circuit diagram of an electrolysis circulation system, for use in a two-stage, batch process according to the invention, FIG. 8 is a graphical illustration of anolyte component concentration using the system of FIG. 7 with first stage electrolysis only, conducted across a non-ionic membrane, FIG. 9 is a graphical illustration of anolyte component concentration using the same system with second stage electrolysis only conducted across a cationic membrane, FIG. 10 is a graphical comparison of anolyte loss during electrolysis between single first stage and single second stage electrolysis, and FIG. 11 represents a circuit diagram of a two-stage electrolysis system for use in a continuous process according to the invention.

CELL DESIGN

A parallel plate and frame cell design was employed. FIG. 1 illustrates a PTFE back plate (10), which acts, in an assembled cell (1), as a support for either an anode or a cathode. The plate (10), has an inlet (11) and an outlet (12) port for an electrolytic solution. The cell was designed with the possibility of a scale up to an industrial plant in mind. Thus the off-centre position of the electrolyte inlet (11) and outlet (12) enables the use of the plate (10) in either an anode or a cathode compartment. Furthermore, if the process is to be scaled up, a simple filter press configuration can be made and stacks of cells connected in parallel. In such a filter press scaled up version, the anolyte and catholyte would circulate through the channels formed by the staggered inlet and outlet ports.

The same concept of off-centre inlet and outlet is also found in the cell electrodes. As illustrated in FIG. 2, a cathode (20) has an inlet (21) and an outlet (22). Electrical contact with the Nb cathode, is made through the protruding lip (23).

PTFE frame separators (30), of the type illustrated in FIG. 3 may form the walls of both the anode and the cathode compartments. The hollow part of the frame (31) has triangular ends (32,33) which are so shaped as to leave the inlet and outlet of the cathode or anode compartment free, whilst blocking the outlet or inlet of the anode or cathode. In the event of a filter press scale up, the electrolyte would circulate through holes specially drilled in the frame.

Figure 4:
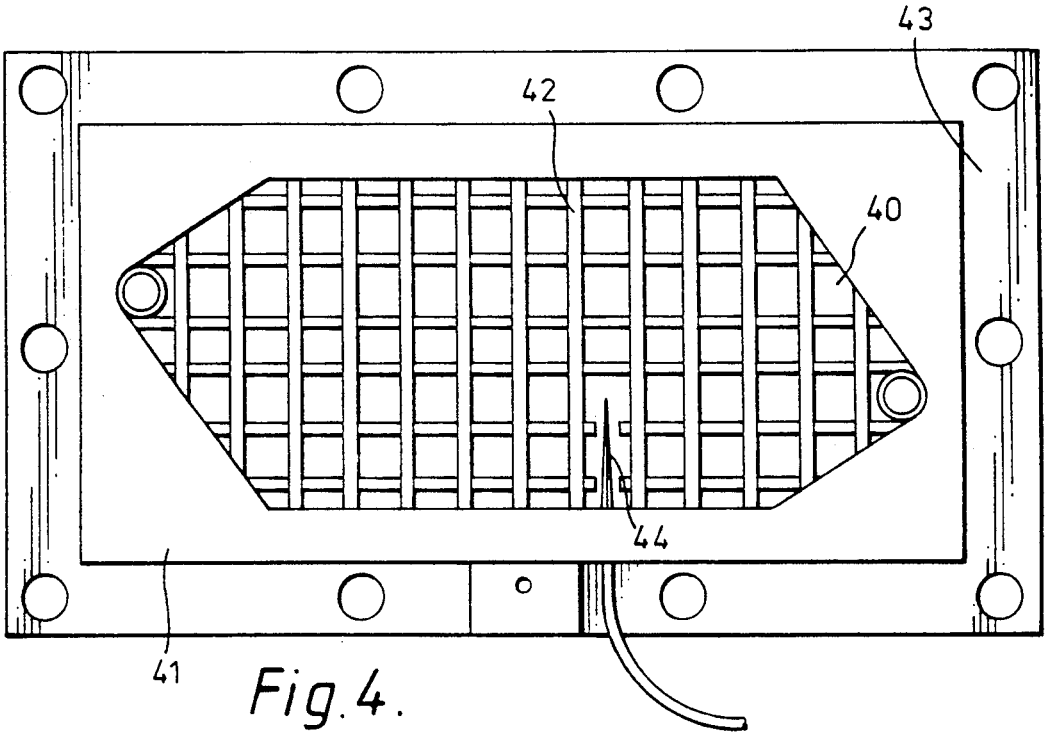
FIG. 4 represents a perspective view of one half of a cell assembly.

FIG. 4 illustrates the first stage of cell assembly, being a cathode compartment. The cathode compartment consists of a PTFE back plate (not shown), on which rests a niobium cathode (40), upon which rests a frame separator 41. Within the hollow part of the frame separator a PTFE coarse grid (42) rests on the cathode (40). The whole assembly rests upon an aluminium back plate (43) having a thickness of 10 mm.

The coarse grid (42) is used to support a cell membrane (not shown) across the cell gap.

Figure 5:
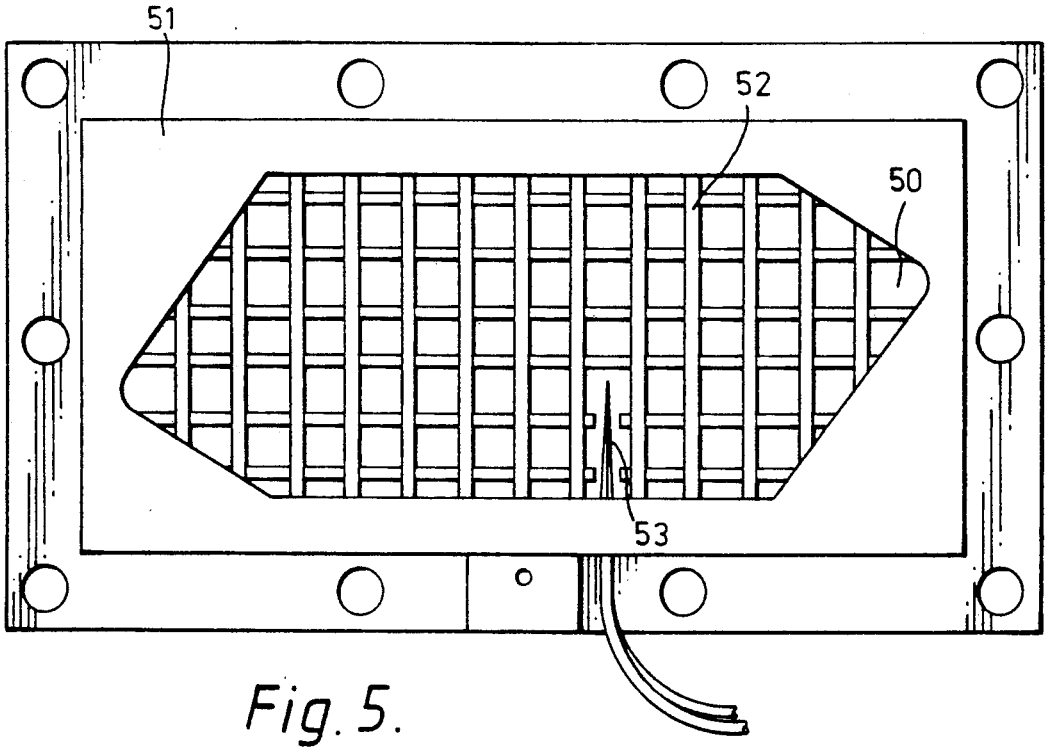
FIG. 5 represents a perspective view of the other half of the cell assembly.

FIG. 5 illustrates the second stage cell assembly, in this case an anode compartment, resting upon the cathode compartment illustrated in FIG. 4 (not shown). The assembly consists of a cell membrane (50) resting directly upon the frame separator (412) (not shown) of the anode compartment, a frame separator (51) resting upon the membrane (50) and a PTFE coarse grid (52) also resting upon the membrane (50) and lying within the hollow part of the frame separator (51). The frame separator (51) is placed in a staggered position with respect to the frame separator (41) of the cathod compartment (see FIG. 4). As mentioned before, such a staggered relationship allows a simple filter press scale up.

The cell (1) is completed, as shown in FIG. 6, by placing a platinised niobium anode (60) on top of the anode separator frame (51), followed by a PTFE back plate (61) on top of the anode (60) and an aluminium plate (62) on top of the back plate (61). In this final form the electrical connection (63) for the anode (60) is on the opposite side of the cell to the electical connection (not shown) for the cathode (40). A PTFE emulsion was used as a sealant for all the parts of the cell and the whole sandwich structure was compressed and held firm by nine tie rods (64) and springs (65). The aluminium plate (43) to the cathode compartment has an inlet (66) and an outlet (67). Similarly the aluminium plate (62) to the anode compartment has an inlet and an outlet (not shown).

A circulation system (70), for use in a batch process and incorporating two of the cells (labelled 1A and 1B) illustrated in FIG. 6, is illustrated in FIG. 7. The anolyte and catholyte are placed in reservoirs (72,74) respectively. The electrolyte is circulated, by means of diaphragm pumps (76, 78), through by-passes (80, 82) to the reservoirs (72, 74), and through Platon (Trade Mark) flow meters (84, 86) to each of the compartments (88A, 90A and 88B, 90B) of each cell (1A, 1B). The electrolyte is returned to the reservoirs (72, 74) through heat exchangers (92, 94) (two tubes in one shell). Each tube of the heat exchangers (92, 94) is used for the catholyte and anolyte circuit respectively. Cooling units (not shown) supplied water at a temperature of 1°-3° C. to the heat exchangers (92, 94). The temperature of the cooling water is monitered with a thermometer (not shown) in the cooling lines; the temperature of the anolyte and catholyte is measured with thermometers (96, 98) incorporated into the corresponding reservoirs (72, 74). Electrolyte enters each compartment of the cells from the bottom via a PTFE tube (not shown). Samples of electrolyte can be taken at the points (100, 102). Each cell (1A, 1B) is independently isolatable from circulated electrolyte by on/off valves (104A, 104B, 106A, 106B, 108A, 108B, 110A, 110B). All the joints in the circuit were sealed with PTFE emulsion before tightening.

The two cells (1A,1B) are identical in all respects except for their respective membranes (50A, 50B). In the first cell (1A), the membrane (50A) is a non-ionic, semi-permeable ion exchange membrane supplied by Fluorotechniques of Albany, N.Y. State USA and consists of fibrous polytetrafluoroethylene (PTFE) doped with about 2% non-crystalline silicon dioxide. In the second cell (1B), the membrane consists of Nafion (Trade Mark) 425, which is a cationic ion exchange membrane material consisting of glass fibre reinforced perfluorinated polymer containing pendant sulphonate ($-SO_3^-$) groups attached to a PTFE backbone through short chain perfluoropolypropylene ether side chains. Nafion 425, and the closely related cationic membrane Nafion 423 which can be used as an alternative, are both marketed by EI du Pont de Nemours Inc.

MODE OF OPERATION OF CIRCULATION SYSTEM(70)

A. Cleaning

The two compartments of each cell were rinsed with 99% $HNO_3$ prior to an experiment, by circulating the acid for 10 minutes. After this period, the reservoirs were drained.

B. Loading

One hour prior to the experiment, the $N_2O_4$ cylinder was placed in a container with crushed ice to ensure that it was present in the liquid state for measuring purposes. The corresponding amount of 99% $HNO_3$ was loaded in both reservoirs and circulated with the cooling system on. Only one of the cells (1A or 1B) was kept in circuit at any one time, the other being isolated by closing its associated on/off valves. Circulation is required to avoid unnecessary evaporation on addition of $N_2O_4$. With the system employed, the temperature was about 10° C., although the cooling liquid had a temperature of about 1° C. The heating was due to the $HNO_3$ pumps.

$N_2O_4$ was poured into a measuring cylinder kept in ice, by simply opening the cylinder valve, inverting the cylinder and gently shaking it. The $N_2O_4$ was added slowly to the anolyte reservoir and optionally to the catholyte reservoir through a glass funnel, but some evaporation was always observed although circulation and cooling was kept on during the addition. For this reason, the analytial concentration measured for the sample before electrolysis, was taken as the true initial value.

c. Electrolysis

With both circulation pumps (71, 71A) and cooling units in operation, voltage was applied to the cell (1A or 1B) in circuit to give the required current and this was manually controlled during the course of the experiment. The rate of circulation was selected to maintain turbulent flow regimes in the compartments, to ensure minimal ionic concentration gradients between each electrode and the membrane and to provide efficient removal of electrical energy from the cell to the heat exchangers. A flow rate of at least 0.1 m $s^{-1}$ through each compartment was found to be adequate. Several samples from both compartments were taken during the run at different times, and both voltages and temperature were monitored. The operating temperature of the cell was maintained at about 10° C.

d. Shutting down procedure

The current was first switched off, then the pumps and cooling system. The two cell compartments were then drained.

e. Safety precautions

Both the polycarbonate swing doors of the cell box and the fume cupboard shield were kept closed during the experiment. For taking samples, the operator always used rubber gloves and full face splash shields. The system was always used with at least two operators present.

ANALYTICAL METHODS

The concentration of $N_2O_4$ and $N_2O_5$ present in the anolyte was determined using a calibrated Laser-Raman spectrometer.

EXAMPLE 1

Non-Ionic Membrane (Comparative)

The system (70) was operated with only the first cell (1A) in circuit. The initial concentration of $N_2O_4$ in the anolyte reservoir (72) was set at 8 wt %. 99% nitric acid was used as the catholyte. With bothe anolyte and catholyte circulating, a potential of about 6 V was then applied across the electrodes (40, 60) causing a current of about 100 Amps to flow through the cell, corresponding to 1400 Amps per square meter of electrode area. Samples of the anolyte were taken regularly and analysed to calculate component concentrations and changes in anolyte mass. When the $N_2O_4$ concentration in the anolyte fell below 3 wt % before the desired concentration of $N_2O_5$ had been reached, further $N_2O_4$ was added to the anolyte to bring the concentration back to 15–20 wt % (see FIG. 8). Voltage was manipulated during the electrolysis to maintain cell current at approximately 100 Amps throughout.

After the passage of about 80 Faradays of charge, it was observed that $N_2O_4$ concentration in the catholyte had reached saturation (about 33 wt %) and was beginning to separate out as a second liquid phase. The catholyte was therefore discarded at this point and replaced with fresh 99% nitric acid.

The results of Example 1 are illustrated graphically in FIGS. 8 and 10, which show that even with apprecable amounts (5–10 wt %) of $N_2O_4$ still remaining and being consumed in the anolyte, $N_2O_5$ concentration levels off at about 26 wt %.

EXAMPLE 2

Cationic Membrane (Comparative)

The system (70) was operated with only the second cell (1B) in circuit. The concentration of $N_2O_4$ in the anolyte was initially set at 18 wt %, and again 99% nitric acid was used as the catholyte. The system was operated in the same manner as that described above in Example 1 at a constant cell current of 100 A, except that replacement of catholyte was found to be unecessary.

The results of Example 2 are illustrated graphically in FIGS. 9 and 10, which show a rapid loss of anolyte mass during electrolysis but also show a steady increase in anolyte $N_2O_5$ concentration to 32 wt % (approaching saturation) coupled with a steady decline in $N_2O_4$ concentration to less than 1 wt %.

EXAMPLE 3

Two-stage Process

Using the results from the previous two Examples, the method of Example 1 using the non-ionic membrane (50A) was repeated until a total of about 100 Faradays of charge had passed and $N_2O_5$ concentration had reached about 22 wt %, just below the concentration at which the rate of increase in concentration begins to fall. Thereafter, the first cell (1A) was isolated from the circuit, the circulating electrolytes were switched through the second cell (1B) having the cationic membrane (50B), and the method of Example 2 used from that point onwards until $N_2O_5$ concentration in the anolyte had reached 32 wt % and $N_2O_4$ concentration less than 1 wt %. Thus, loss of anolyte mass was minimised by undertaking the bulk of the electrolysis using the first cell (1A), the second cell (1B) only being used to refine the product and increase $N_2O_5$ concentration to the required level.

EXAMPLE 4

Continuous Process

A process flow diagram of a two-stage system operating in cascade and using a series of two batteries (200, 202) each of four cells (only one shown) of the type illustrated in FIG. 6 connected in parallel, is shown in FIG. 11, which is to some extent simplified by the omission of valves. The anolyte compartments (200A) and catholyte compartments (200B) of the first stage battery (200) are separated by a non-ionic, semi-permeable membrane (200C) whereas the anolyte compartments (202A) and catholyte compartments (202B) of the second stage battery (202) are separated by a cationic ion-exchange membrane (202C). Electrical energy is supplied to all cells from current controlled low ripple d.c. sources (not shown).

The anolyte for the first stage battery (200) is stored in a reservoir (204) and comprises a saturated solution of $N_2O_4$ in 98% $HNO_3$ (206) below an upper layer of liquid $N_2O_4$ (208). The anolyte is cooled to between 15° and 25° C., preferably between 15° and 20° C., by a cooling coil (210) through which flows water at 1°-3° C. The anolyte is circulated by means of a centrifugal pump (212), through an $N_2O_4$ separator (214) which returns free liquid $N_2O_4$ to the reservoir (204), to the anolyte compartments (200A) of the battery (200). The battery (200) is operated under conditions which produce maximum levels of $N_2O_5$ in the anolyte exiting from the battery (200) of typically about 20-25 wt % by weight of nitric acid. The use of the two-phase reservoir (204) uniquely allows maximum levels of $N_2O_4$ to be maintained under easily controlled conditions (such as reservoir temperature control) in the main $N_2O_5$ production stage.

The electrolysed anolyte from the anolyte compartment (200A) is passed as a cascade overflow stream (215) to a second reservoir (216), also cooled by a cooling coil (218), and is from there circulated at a temperature of between 10° and 25° C., preferably between 15° and 20° C., through the anolyte compartments (202A) of the second battery (202) by a second centrifugal pump (220). The battery (202) is operated so as to reduce the $N_2O_4$ concentration in the anolyte to a minimum level of typically less than 2 wt %, preferably less than 1 wt %, of nitric acid. The final product, which typically contains more than 30 wt % $N_2O_5$ (for example 32 wt %) is taken as a cascade overflow stream (221) from the anolyte exiting from the battery (202).

The catholyte from each cathode compartment (200B, 202B), which is not cooled so as to maintain its temperature above 20° C. (preferably between 20° and 30° C.) to aid $N_2O_4$ stripping, is passed to an $N_2O_4$ fractionating column (222) which includes a heating coil (224), from whence $N_2O_4$ vapour is distilled out, dried in a packed column dryer (226), condensed by a condensor (228) and returned to the first stage anolyte reservoir (204). Residual liquid catholyte from which excess $N_2O_4$ has been distilled is collected in a third reservoir (230) cooled by a cooling coil (232), and recirculated to the cathode compartments (200B, 202B) by a centifugal pump (234). Excess spent catholyte is continuously drained off.

The operating conditions of the two batteries of cells are controlled by monitoring the density and flowrate of the anolyte in density indicators (236, 238) and flowmeters (240, 242). The $N_2O_4$ (impurity) concentration in the final product is measured by a Laser-Raman spectrometer. Make-up nitric acid is continuously fed to the first stage anolyte and to the catholyte through metering pumps (246) and (248) respectively, and make-up $N_2O_4$ is continuously fed to the first stage anolyte through a metering pump (250).

I claim:

1. A method for the electrochemical generation of $N_2O_5$ comprising the steps of:

(a) simultaneously oxidizing an anolyte comprising a solution of $N_2O_4$ in nitric acid and decomposing a catholyte comprising nitric acid, in a first production stage, said anolyte and catholyte being separated by a non-ionic, semi-permeable ion exchange membrane or an anionic ion exchange membrane, and (b) simultaneously oxidizing anolyte from said first production stage and decomposing a catholyte comprising nitric acid, in a second production stage, said anolyte and catholyte being separated by a cationic ion exchange membrane.

2. The method according to claim 1 comprising oxidizing the anolyte in the first production stage until said anolyte contains more than 15 wt % $N_2O_5$.

3. The method according to claim 2 comprising oxidizing the anolyte in the first production stage until said anolyte contains more than 20 wt % $N_2O_5$.

4. The method according to claim 1 comprising oxidizing the anolyte in the second production stage until said anolyte contains more than 25 wt %, $N_2O_5$.

5. The method according to claim 4 comprising oxidizing the anolyte in the second production stage until said anolyte contains more than 30 wt % $N_2O_5$.

6. The method according to claim 1 comprising generating at least 70% of the $N_2O_5$ in the first production stage.

7. The method according to claim 1 wherein the catholyte of each of the production stages contains from 10 wt % to saturation $N_2O_4$.

8. The method according to claim 7 wherein the catholyte of each of the stages contains from 20 wt % to 30 wt % $N_2O_4$.

9. A method according to claim 1 comprising at least partly recirculating the anolyte through the first stage.

10. A method according to claim 9 comprising at least partly recirculating the anolyte from the first production stage through a reservoir containing the anolyte as a first liquid phase and liquid $N_2O_4$ as a second liquid phase.

11. The method according to claim 10 comprising controlling the amount of $N_2O_4$ dissolved in the anolyte of the first stage within the reservoir by controlling the temperature of the reservoir.

12. The method according to claim 11 comprising continuously adding anolyte from the first stage to the anolyte of the second stage and prior to the addition of the anolyte from the first stage, continuously removing part of the anolyte from the second stage as a product stream.

13. The method according to claim 9 comprising at least partly recirculating the anolyte through the first stage, separating the recirculated anolyte of the first stage into two parts, supplying a first part of the recirculated anolyte to the second stage, adding $N_2O_4$ and nitric acid to a second part of the recirculated anolyte and recirculating said second part through the first stage.

14. The method according to claim 13 comprising continuously adding anolyte from the first stage to the anolyte of the second stage and prior to the addition of the anolyte from the first stage, continuously removing part of the anolyte from the second stage as a product stream.

15. The method according to claim 1 comprising at least partly recirculating the anolyte through the second stage.

16. The method according to claim 1 comprising oxidizing the anolyte in the second production stage until said anolyte contains less than 3 wt % $N_2O_4$.

17. The method according to claim 16 comprising oxidizing the anolyte in the second production stage until said anolyte contains less than 2 wt % $N_2O_4$.

* * * * *